US006548949B2

(12) United States Patent
Ishihara

(10) Patent No.: US 6,548,949 B2
(45) Date of Patent: Apr. 15, 2003

(54) WEDGE BASE BULB

(75) Inventor: Yoshihisa Ishihara, Osaka (JP)

(73) Assignee: Nipro Corporation, Osaka (JP)

( * ) Notice: Subject to any disclaimer, the term of this patent is extended or adjusted under 35 U.S.C. 154(b) by 88 days.

(21) Appl. No.: 09/773,832

(22) Filed: Jan. 31, 2001

(65) Prior Publication Data

US 2001/0013748 A1 Aug. 16, 2001

(30) Foreign Application Priority Data

Feb. 2, 2000 (JP) ..... 2000-024661

(51) Int. Cl.[7] ..... H01J 5/48
(52) U.S. Cl. ..... 313/318.09; 313/578
(58) Field of Search ..... 313/315, 318.01, 313/318.09, 578, 318.06; 264/1.1, 1.9; 501/1, 41, 44; 362/311; 427/105, 106

(56) References Cited

U.S. PATENT DOCUMENTS

| | | | | |
|---|---|---|---|---|
| 4,052,638 A | * | 10/1977 | Love et al. | 313/318 |
| 4,243,907 A | | 1/1981 | Kohl et al. | 313/318 |
| 4,603,278 A | | 7/1986 | Devir et al. | 313/318 |
| 4,633,127 A | | 12/1986 | Beurskens et al. | 313/112 |
| 4,724,353 A | | 2/1988 | Devir | 313/318 |
| 4,749,901 A | | 6/1988 | Demas | 313/315 |
| 4,837,479 A | * | 6/1989 | Devir et al. | 313/318 |
| 4,883,434 A | | 11/1989 | Toyoshima | 439/619 |
| 5,275,764 A | | 1/1994 | Hettinga | 264/1.9 |
| 5,523,650 A | | 6/1996 | Terheijden et al. | 313/578 |
| 5,528,101 A | | 6/1996 | Gosslar et al. | 313/493 |
| 5,639,702 A | * | 6/1997 | Imashita et al. | 501/44 |
| 6,411,021 B1 | * | 6/2002 | Izawa et al. | 313/315 |

FOREIGN PATENT DOCUMENTS

| | | |
|---|---|---|
| FR | 2722030 | 1/1996 |
| JP | 2-100259 | 4/1990 |
| JP | 10003889 | 1/1998 |
| WO | WO 98/54753 | 12/1998 |

* cited by examiner

*Primary Examiner*—Hoan Tran
(74) *Attorney, Agent, or Firm*—W. F. Fasse; W. G. Fasse

(57) ABSTRACT

The wedge base bulb includes a bulb body having a colored glass bulb and a press-sealed portion. Further, a tubular insulation collar is mounted to cover press-sealed portion. Bulb body is formed in a process in that a molding section of a glass tube including a color-developing compound or a color-developing element is heat-melted under a reducing atmosphere in a predetermined temperature region, placed in a mold and expanded in the mold, and also develops color with colloid generated by the heat-melting. As a result, a wedge base bulb developed a color and chromaticity satisfying a predetermined standard can be provided at a lower cost.

16 Claims, 4 Drawing Sheets

WEDGE BASE BULB

BACKGROUND OF THE INVENTION

1. Field of the Invention

The present invention relates to a wedge base bulb, and more particularly to a structure of a wedge base bulb utilized for a direction indicator lamp and a tail/stop lamp of an automobile or the like.

2. Description of the Background Art

A bulb utilized for a direction indicator lamp or a tail/stop lamp of an automobile has made the transition from a base-attached bulb 200 shown in FIG. 7 to a wedge base bulb 300 shown in FIG. 8 since the latter half of 1980's, for the purpose of attaining lighter weight, automated assembling, reduced cost and so forth. Currently, wedge base bulb 300 is employed for most automobiles. For example, a direction-indicating lamp unit utilized for an automobile is constituted by a synthetic resin lamp lens colored with a warm color of amber, and a colorless and transparent wedge base bulb.

In recent years, however, more importance has been attached to design of automobiles, so that a direction-indicating lamp unit, in which the synthetic resin lamp lens is made colorless and transparent whereas the glass bulb itself is colored with the warm color of amber, has been employed.

An industrially utilized colored glass of a warm color tone such as red, amber, yellow or the like is processed by heat-melting a glass including a color-developing compound of CdS and CdSe or the like, or a color-developing element of Au, Cu or the like under an atmosphere where no such a color-developing element is oxidized (hereinafter referred to as reducing atmosphere) for a few minutes to a few hours in a predetermined temperature region (so-called colloid coloring). By making most use of these appropriate processing conditions, coloring of the bulb for an automobile is enabled.

When the base-attached bulb is employed for the direction-indicating bulb of an automobile, the glass bulb is manufactured by a manufacturing process described below to enable development of a desired color and chromaticity (amber). First, a molding section of a glass tube colored with CdS—CdSe colloid (coloring is insufficient in this state) is re-melted under the reducing atmosphere in a predetermined temperature region (in a range of the glass softening temperature to the glass softening temperature +100° C. or lower). Subsequently, the melted glass tube is placed in a mold, and air is blown into the glass tube (or negative pressure is produced for suction in the mold) to expand the glass tube.

However, in a conventional method, when the wedge base bulb is employed for a direction indicating bulb of an automobile, one end of a glass tube colored by CdS—CdSe colloid (coloring is insufficient in this state) is melted under the reducing atmosphere and in a predetermined temperature region (in a range of the glass softening temperature to the glass softening temperature +100° C. or lower) to form a hemispheric shape, and the other end is press-sealed under the reducing atmosphere and in a predetermined temperature region (in a range of the glass softening temperature to the glass softening temperature +100° C. or lower) in a similar manner. Thus, a hemispheric head (portion A) and a press-sealed portion (portion C) of the glass bulb of a wedge base bulb 300 shown in FIG. 8 can develop a desired color.

Whereas, a tubular body (portion B) is not re-melted under the reducing atmosphere and in a predetermined temperature region, resulting in unsatisfactory color development.

Further, the glass bulb of the wedge base bulb may be formed to have a standard wall thickness by a manufacturing process similar to that for the base-attached bulb, in which the glass tube colored by CdS—CdSe colloid (coloring is insufficient in this state) is re-melted under the reducing atmosphere in a predetermined temperature region (in a range of the glass softening temperature to the glass softening temperature +100° C. or lower), is placed in a mold, and air is blown into the glass tube (or negative pressure is produced for suction in the mold), to expand the glass tube, and then the resulted tube is press-sealed. However, the press-sealed portion will have an insufficient thickness, since only a little glass material can be appropriated for the press-sealed portion.

If the glass bulb is to be manufactured by making the wall of a conventional glass tube thicker such that the wall thickness of the press-sealed portion would be a predetermined thickness, a longer processing time will be required. Further, an expensive colored glass is used, so that the wedge base bulb will be very expensive. Moreover, because of the thicker wall, desirable color, chromaticity and luminous flux may not be attainable.

With the technical background described above, the current state is such that the amber-colored direction indicating bulb must be selected from either the base-attached bulb which can be manufactured to have a relatively thin wall, or the wedge base bulb formed by coating paint on the surface of the colorless and transparent glass bulb.

However, if the base-attached bulb is employed, a socket must be changed from the one for the wedge base bulb used for most automobiles to the one for the base-attached bulb, which would be a negative factor in cost. Also, this would go against the current of the times toward the wedge-based bulbs for automobiles.

Furthermore, if the wedge base bulb of a conventional colorless and transparent glass bulb is employed and paint is coated on the surface of the glass bulb, it would be difficult to coat the surface without a risk of generating coating unevenness, pinholes or the like thereon, and also the paint may be discolored or stripped due to a raised temperature of the light when it is on.

SUMMARY OF THE INVENTION

An object of the present invention is to provide a wedge base bulb for solving the problems described above, which accommodates to a socket for the wedge base bulb and produces a predetermined color and chromaticity.

To achieve the object described above, a wedge base bulb according to the present invention includes a bulb body including a colored glass bulb, a filament housed in the colored glass bulb and a lead connected to the filament at a tip-end side thereof, the bulb body being press-sealed so as to expose a proximal-end side of the lead from the colored glass bulb; and a tubular insulation collar attached to cover a press-sealed portion of the bulb body. The colored glass bulb is formed by a process in that a molding section of the glass tube including a color-developing compound or a color-developing element is heat-melted under a reducing atmosphere and in a predetermined temperature region and thereafter the glass tube is placed in a mold and expanded in the mold, and also develops color with colloid generated by the heat-melting.

Thus, in the wedge base bulb according to the present invention, the colored glass bulb molded to have a thin wall and color-developed with colloid is employed and then a press-sealed portion with insufficient wall thickness is compensated by the insulation collar, to accommodate to a socket for the wedge base bulb of a predetermined shape. Further, the wedge base bulb developed to desired color and chromaticity can be attained at a low cost.

Preferably, the glass tube has a heat-melting temperature ranging from a softening temperature of the glass bulb to a glass softening temperature +100° C. or lower. Further, the color-developing compound is preferably a compound selected from a group consisting of CdS, $Cu_2O$, FeS, $SbS_2$ and $Sb_2S_3$. Preferably, the color-developing compound is a mixture of CdS and CdSe. Further, the color-developing element is preferably an element selected from a group consisting of Cu, Ag, Au, S, Se and P. Preferably, an outer surface of the press-sealed portion and an inner surface of the insulation collar are respectively provided with engagement regions engaging with each other. Preferably, an inner surface of the insulation collar is provided with a ridge extending along an inserting direction of the press-sealed portion. Preferably, the ridge is provided in a number of four to twelve.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
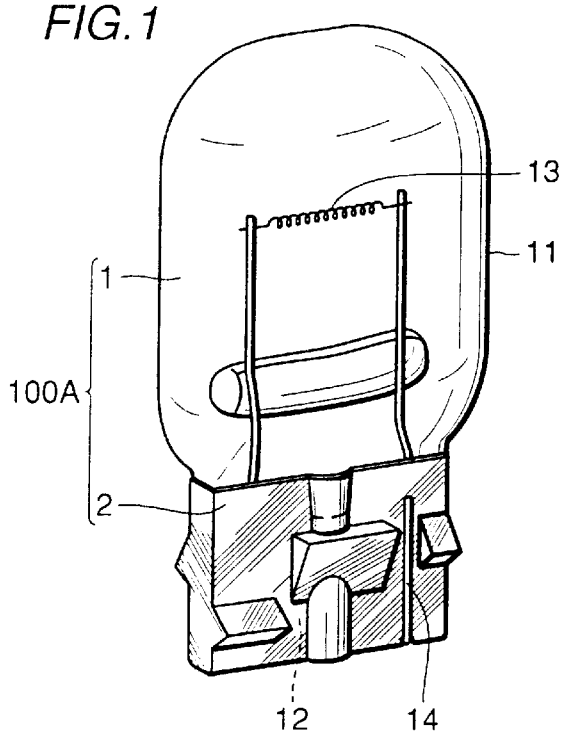
FIG. 1 is a perspective view showing a configuration of a wedge base bulb 100A according to an embodiment of the present invention.

A wedge base bulb, a method of manufacturing thereof, and an insulation collar used for the wedge base bulb according to an embodiment of the present invention will be described below with reference to the drawings.

Structure of Wedge Base Bulb

A structure of a wedge base bulb 100A according to an embodiment of the present invention is described with reference to FIGS. 1 and 2. Wedge base bulb 100A includes a bulb body 1 and an insulation collar 2. Bulb body 1 includes a colored glass bulb 11 having a hemispheric head portion and an approximately cylinder body portion, and a press-sealed portion 12. Colored glass bulb 11 houses a filament 13 therein. Filament 13 is connected to a lead 14 with a tip-end side thereof connected to filament 13 and a proximal-end side thereof exposed from press-sealed portion 12.

Figure 2:
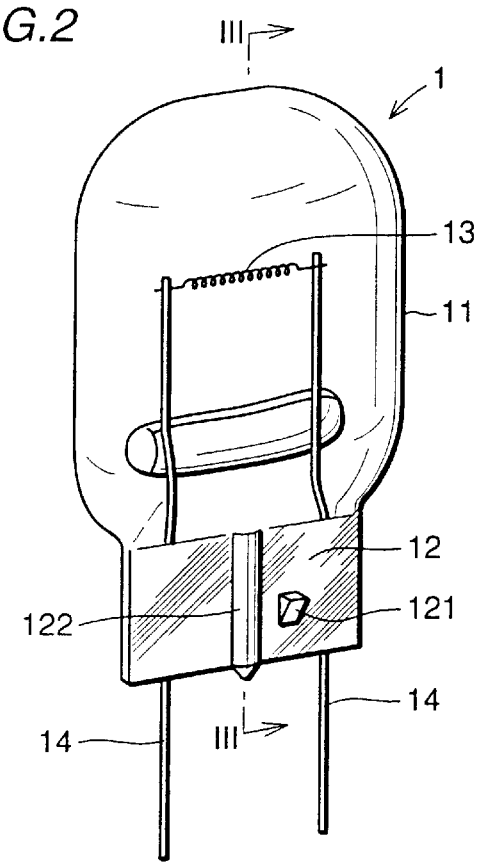
FIG. 2 is a perspective view showing a bulb body 1 of wedge base bulb 100A according to an embodiment of the present invention.

The proximal-end side of lead 14 is exposed from an end of press-sealed portion 12, and bent along insulation collar 2 attached to cover press-sealed portion 12, as shown in FIG. 1. When the wedge base bulb is mounted to a socket (not shown), lead 14 is electrically connected and the light is turned on.

Figure 6:
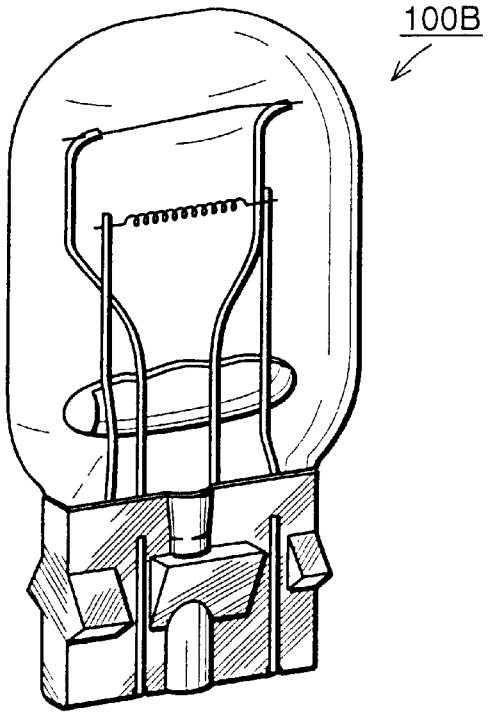
FIG. 6 is a perspective view showing a configuration of a wedge base bulb 100B according to another embodiment of the present invention.
Figure 7:
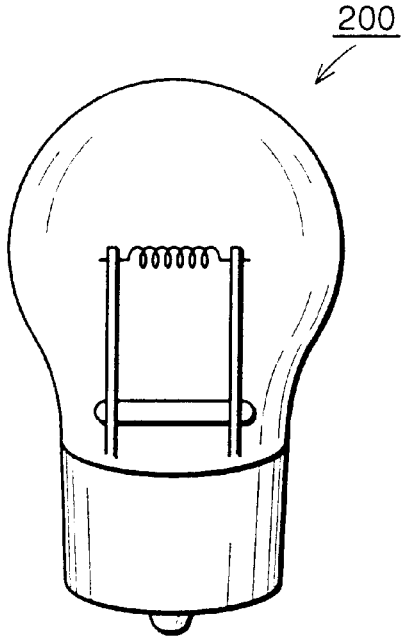
FIG.7 PRIOR ART
FIG. 7 is a perspective view of a base-attached bulb 200 in a conventional art.

In general, a single-filament wedge base bulb 100A is employed, in which one filament 13 is housed as shown in FIG. 1, for a direction indicator lamp for an automobile. Further, for a tail/stop lamp of an automobile, a double-filament wedge base bulb 100B is employed, in which two filaments 13 are housed as shown in FIG. 6.

Figure 3:
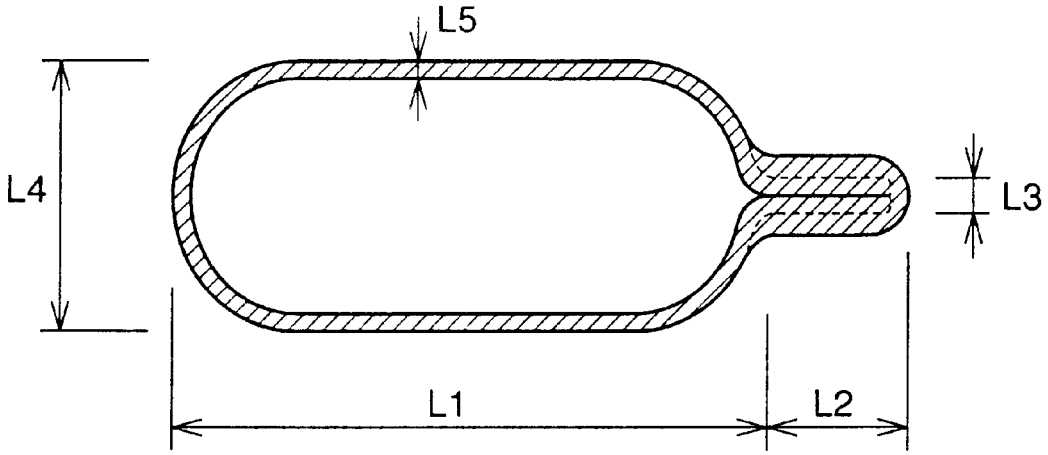
FIG. 3 is a section view taken along line III—III in FIG. 2 in the direction of the arrow.
Figure 8:
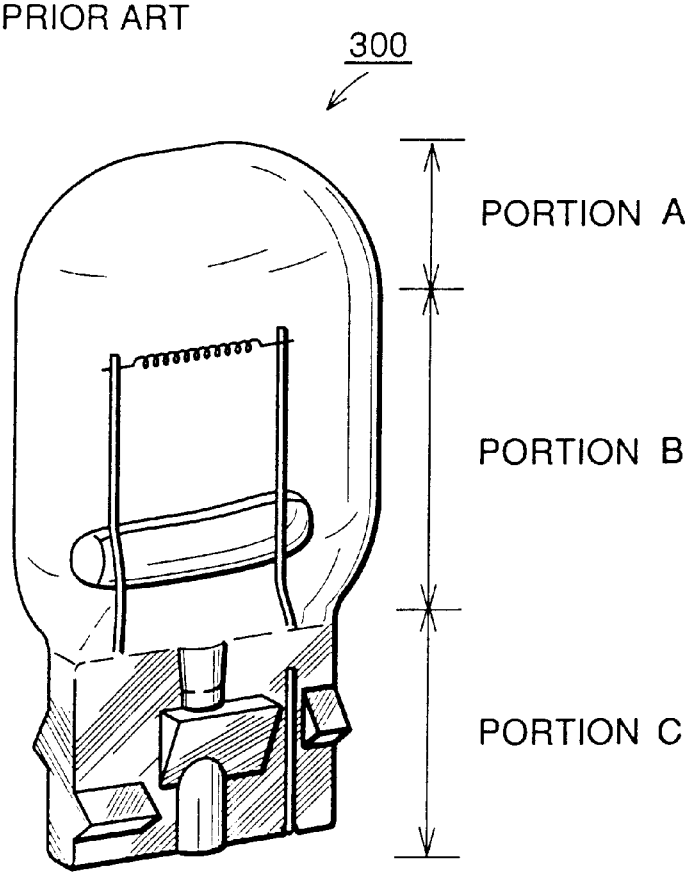
FIG.8 PRIOR ART
FIG. 8 is a perspective view of a wedge base bulb 300 in a conventional art.

Insulation collar 2 is attached to cover press-sealed portion 12. Colored glass bulb 11 is formed by coloring a cylindrical glass tube including a color-developing compound or a color-developing element to a warm color of amber such that the hemispheric head portion, the tubular body portion and the press-sealed portion of the glass bulb are sufficiently and evenly colored, by employing a manufacturing method as described in the following. The shape of bulb body 1 according to the present embodiment is formed as shown in FIG. 3 and as indicated in Table 1 below. For a reference, the shape of the conventional wedge base bulb shown in FIG. 8 is also indicated.

TABLE 1

| | | | | L4 | | L5 | |
|---|---|---|---|---|---|---|---|
| | L1 | L2 | L3 | before mold | after mold | before mold | after mold |
| Bulb body 1 | ≦32 | 10 | 2.1 | ϕ15.25 | ϕ 20 | 0.76 | 0.4 |
| Conventional art | ≦32 | 12 | 3 | ϕ 20 | ϕ 20 | 0.82 | 0.82 |

(Unit: mm)

Press-sealed portion 12 is provided, on either side of the outer surfaces thereof, with a convex portion 121 and a semi-columnar air-releasing portion 122 formed by placing an air-releasing pipe for press sealing at the time of manufacturing described later. Convex portion 121 is for engaging a concave portion 23 provided on an inner wall of subsequently-described insulation collar 2, to fix insulation collar 2.

Structure of Insulation Collar 2

Figure 4:
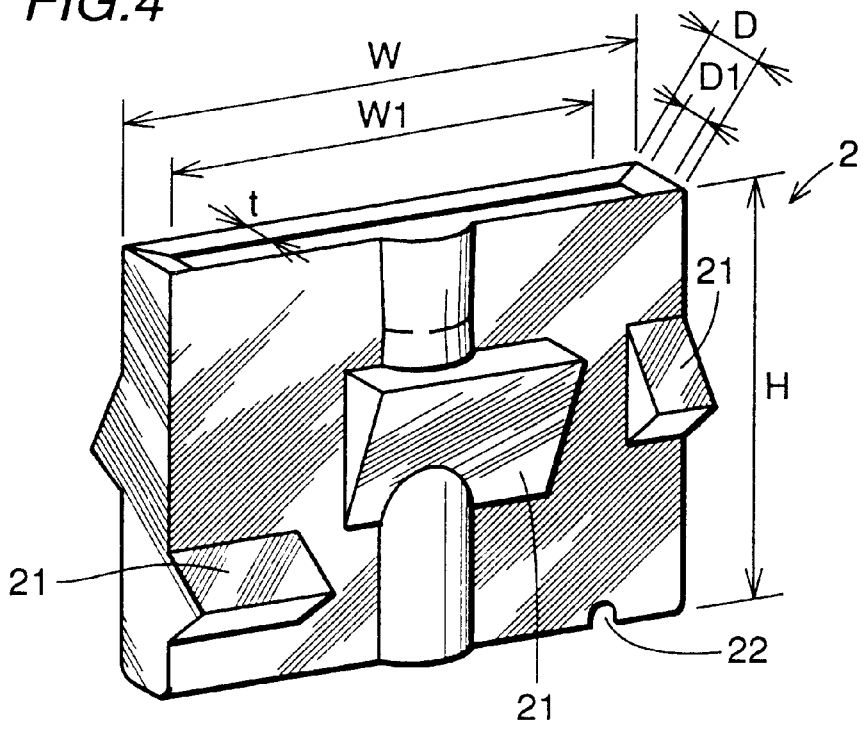
FIG. 4 is a perspective view showing a configuration of a resin collar 2 of wedge base bulb 100A according to an embodiment of the present invention.

The structure of insulation collar 2 will now be described with reference to FIGS. 4 and 5. Insulation collar 2 has a tubular shape attached to cover press-sealed portion 12 of bulb body 1, as shown in FIG. 1. The outside dimension of insulation collar 2 is as indicated in Table 2.

TABLE 2

| W | W1 | D | D1 | H | t |
|---|---|---|---|---|---|
| 16 mm | 15.2 mm | 3 mm | 2.2 mm | 12 mm | 0.4 mm |

Because wedge base bulb 100A having thin-walled press-sealed portion 12 of bulb body 1 cannot be secured to a socket of a predetermined standard shape, insulation collar 2 is provided to function as an auxiliary adapter for solving such a problem. Though the thickness of insulation collar 2 is herein made approximately 0.4 mm, it may generally be in a range of 0.3 to 0.6 mm.

Though any thermal-resistant material may be used as a material for forming insulation collar 2, a resin material such as nylon, polytetrafluoroethylene or thermosetting phenol resin may preferably be used in terms of their superior thermal resistance and resilience.

A plurality of protrusions 21 are provided on both front and back sides of the outer surfaces of insulation collar 2 in the same manner, for engaging a socket (not shown) for the wedge base bulb while preventing side to side displacement of lead 14 of bulb body 1. The arranged positions and the shapes of the plurality of protrusions 21 are appropriately selected in accordance with a predetermined standard. These positions and shapes allow single-filament wedge base bulb 100A shown in FIG. 1 to be distinguished from double filament wedge base bulb 100B shown in FIG. 6.

A lower end portion of insulation collar 2 is provided with a groove 22 which facilitates bending of lead 14 as well as aligning thereof. The number of grooves 22 depends on the number of leads 14 to be exposed. Two grooves 22 are provided in single-filament wedge base bulb 100A shown in FIG. 1, whereas four grooves 22 are provided in double-filament wedge base bulb 100B shown in FIG. 6. By checking the number of grooves 22, mis-assembling of the insulation collar, such as assembling of a single-filament glass bulb to a double-filament insulation collar, can be prevented.

Figure 5:
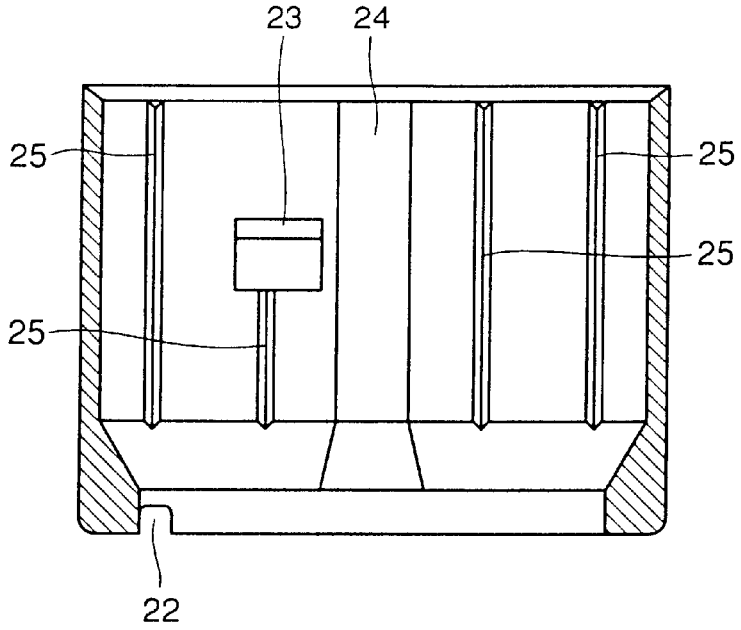
FIG. 5 is a vertical section view of resin collar 2.

Referring to FIG. 5, the inner surface of insulation collar 2 is provided with concave portion 23 engaging with convex portion 121 provided on the above-described press-sealed portion 12, and a semi-columnar groove 24 provided corresponding to the shape of air-releasing portion 122 (the outer wall of insulation collar 2 is raised corresponding to this semi-columnar groove 24). The inner surface of insulation collar 2 is further provided with a plurality of ridges (elongated protruding portions) 25, each having a shape of a triangular prism, along with an inserting direction of press-sealed portion 12.

Ridges 25 are provided as means for preventing staggering of insulation collar 2 due to a slight difference in wall thickness and width of a flat plane of press-sealed portion 12 for each product. Here, each ridge 25 preferably has a height of 0.1 to 0.3 mm and a width of approximately 0.2 to 0.5 mm. With such height and width, ridge 25 is more or less crushed around the top thereof when insulation collar 2 is attached to press-sealed portion 12, resulting in secure fixing. Further, ridge 25 is formed preferably, but not limited thereto, to have a shape of the triangular prism as shown in the present embodiment, or of a semi-column.

Furthermore, the number of ridges 25 is preferably, but not limited thereto, approximately four to twelve. When the wall of press-sealed portion 12 is thin, less than four ridges 25 may be insufficient for securing. When the wall of press-sealed portion 12 is thick, on the other hand, more than twelve ridges 25 may make the attachment troublesome. To prevent staggering of press-sealed portion 12, ridge 25, not necessarily of a shape of the triangular prism but possibly of a small protrusion or the like, may be provided in a longitudinal direction as shown in FIG. 5, to pull a mold with hardly any damage to the inner surfaces of insulation collar 2. Therefore, this has the advantage that insulation collar 2 can easily be integrally molded. It is noted that a fixing means such as ridge 25 or the like may be dispensed with if accurate molding of press-sealed portion 12 and insulation collar 2 can be attained.

Method of Manufacturing Bulb Body 1

A method of manufacturing bulb body 1 having a colored glass bulb 11 and a press-sealed portion 12 is now described. First, the molding section of a glass tube including a color-developing compound or a color-developing element is heat-melted under the reducing atmosphere in a predetermined temperature region. The dimension of the glass tube at that time corresponds to the dimension before molding in Table 1 indicated above. Subsequently, the glass tube is placed in a mold and expanded. The molded bulb body 1 develops desired color and chromaticity with the colloid generated by the heat-melting. The wall thickness of the head portion and the body portion of bulb body 1 after molding will generally be 0.3 to 0.6 mm.

For example, when a glass tube including a CdS—CdSe mixture as an amber color-developing compound is produced to manufacture bulb 1 from the glass tube, a large amount of main coloring components of Cd, Se and S are first required to be evenly remained in order to attain secure colloid coloring. These components are volatile in a state of element or sulfide, so that a basic glass composition, a raw material used, an additive for adjusting oxidation-reduction state, and so forth are determined before further appropriately adjusting melting temperature and atmosphere.

By satisfying these conditions, a component required for the color-developing may be included in the glass. However, a usual molding process of the glass tube is performed under the oxidizing atmosphere and a temperature approximately in a range of 900° C. to 1000° C., so that growth of colloid is insufficient and no colloid develops to a desired color and chromaticity.

Thus, the molding section of the glass tube is re-melted under the reducing atmosphere (an atmosphere where no color-developing element of a main coloring component is oxidized), in a predetermined temperature region (in a range of the glass softening temperature to the glass softening temperature +100° C. or lower) for a predetermined period of time (few minutes to few hours), is placed in the mold, and air is blown into the glass tube to expand the same (or negative pressure is applied to the mold for suction), which is thereafter press-sealed.

This enables attainment of a bulb body with a colored glass bulb developed to a desired color and chomaticity. It is noted that a possible color-developing compounds other than the ones described above may be selected from a group consisting of CdS, $Cu_2O$, FeS, $SbS_2$ and $Sb_2S_3$, and a colored glass bulb may also be attained similarly from a glass tube including these compounds.

Besides the coloring by the compound colloid, a coloring method using element colloid may also be used. An element selected from a group consisting of Cu, Ag, Au, S, Se and P may be used for a color-developing element. Again in this case, it is necessary to appropriately determine the basic glass composition, the raw material used, the additive for adjusting the oxidation-reduction state, to manufacture the glass tube. The glass tube is then heat-melted under the reducing atmosphere and in a predetermined temperature region to cause thermal reduction of the element to produce element gas.

When the element gas reaches a certain concentration or above, it aggregates and precipitates as crystal (colloid) to develop color. This is when absorbed wavelength and intensity are determined by the number and size of the crystal (colloid), and thereby color and chromaticity of the colored glass bulb are determined.

Thereafter, both a convex portion 121 and a semi-columnar air-releasing portion 122 formed by placing an air-releasing pipe for press sealing at the time of manufacturing are provided on either side of press-sealed portion 12 of colored glass bulb 11. Here, convex portion 121 is preferably provided approximately one on one side only or one on each side, since it would be difficult to provide a plurality of convex portions 121 on thin press-sealed portion 12.

Further, it is also possible to provide a concave portion on press-sealed portion 12 and a convex portion on insulation collar 2, which however would make the glass wall thickness of the portion from the concave portion of press-sealed portion 12 to lead 14 very thin, resulting in possible crack, damage, leakage or the like. Thus, convex portion 121 is preferably provided on press-sealed portion 12 as described in the present embodiment. It is noted that press-sealed portion 12 may be manufactured to form no air-releasing portion 122 even if the air-releasing pipe is provided, in which case press-sealed portion 12 is formed flat except for convex portion 121.

A method of manufacturing bulb body 1 of a wedge base bulb according to the present embodiment is summarized below.

(i) A glass tube section, required for molding of bulb body 1, of a long glass tube including a color-developing compound or a color-developing element is melted in a predetermined temperature region (in a range of the glass softening temperature to the glass softening temperature +100° C. or lower) and is placed in a mold, and air is blown into the glass tube (or negative pressure is applied to the mold for suction), to expand the glass tube.

(ii) The melted portion is cut from the long glass tube.

(iii) Filament 13 and a portion of lead 14 connected thereto are housed in the melt-molded bulb body 1, with an air-releasing pipe arranged at an opening portion thereof.

(iv) The opening portion is press-sealed.

(v) Air is released from the air-releasing pipe to make the inside of bulb body 1 vacuum. Alternatively, inert gas is injected into bulb body 1 after making the body vacuum.

(vi) An end portion of the air-releasing pipe is closed.

(vii) Insulation collar 2 is molded and mounted to cover press-sealed portion 12.

(viii) Lead 14 exposed from an end portion of press-sealed portion 12 is bent along insulation collar 2.

Effects

As has been described above, according to the wedge base bulb in the present embodiment, a colored wedge base bulb can be used without change of a socket from the one for the wedge base bulb to the one for the base-attached bulb. Further, a wedge base bulb which has developed color and chomaticity that satisfies a predetermined standard can be provided at a lower cost. Moreover, mounting of wedge base bulb 100A can be facilitated for various types of sockets by using bulb body 1 of wedge base bulb 100A as a common part and only changing the shape of the outer surface of insulation collar 2.

Although the present invention has been described and illustrated in detail, it is clearly understood that the same is by way of illustration and example only and is not to be taken by way of Imitation, the spirit and scope of the present invention being limited only by the terms of the appended claims.

What is claimed is:

1. A wedge base bulb, comprising:

a bulb body including a colored glass bulb, a filament housed in said colored glass bulb and a lead connected to said filament at a tip-end side thereof, said bulb body having a press-sealed portion that is press-sealed so as to expose a proximal-end side of said lead from said colored glass bulb; and a tubular insulation collar attached to cover said press-sealed portion of said bulb body;

wherein said colored glass bulb is made of a glass which itself develops a color of said colored glass bulb, and does not include a colored coating on an outer surface of said glass bulb.

2. The wedge base bulb according to claim 1, wherein said color of said colored glass bulb is amber.

3. The wedge base bulb according to claim 1, wherein an outer surface of said press-sealed portion and an inner surface of said insulation collar are respectively provided with engagement regions engaging with each other.

4. The wedge base bulb according to claim 1, wherein an inner surface of said insulation collar is provided with a ridge extending along an inserting direction of said press-sealed portion being inserted into said insulation collar.

5. A process of making the wedge base bulb according to claim 1, comprising heat-melting a molding section of a glass tube made of said glass including a color-developing compound or a color-developing element under a reducing atmosphere in a predetermined temperature range, and thereafter placing said glass tube in a mold and expanding said glass tube in said mold, so as to form said colored glass bulb, wherein said glass of said glass bulb develops said color with a colloid generated by said heat-melting.

6. The process of making the wedge base bulb according to claim 5, wherein said glass tube has a heat-melting temperature ranging from a glass softening temperature of said glass to said glass softening temperature +100° C. or lower.

7. The process of making the wedge base bulb according to claim 5, wherein said glass includes said color-developing compound which is a compound selected from a group consisting of CdS, $Cu_2O$, FeS, $SbS_2$ and $Sb_2S_3$.

8. The process of making the wedge base bulb according to claim 5, wherein said glass includes said color-developing compound which is a mixture of CdS and CdSe.

9. The process of making the wedge base bulb according to claim 5, wherein said glass includes said color-developing element which is an element selected from a group consisting of Cu, Ag, Au, S, Se and P.

10. A wedge base bulb comprising:

a bulb body integrally including a colored glass bulb enclosing a sealed space therein and a press-sealed portion;

at least one filament arranged in said sealed space;

two respective electrical leads respectively connected to a respective one of said at least one filament in said sealed space and extending out of said bulb body through said press-sealed portion; and a tubular insulation collar fitted externally onto said press-sealed portion of said bulb body;

wherein said colored glass bulb consists of a glass material that contains a colloid formed by a color-developing agent that develops a color directly in said glass material of said colored glass bulb.

11. The wedge base bulb according to claim 10, wherein said colored glass bulb integrally includes a hemispherical portion opposite said press-sealed portion, and a cylindrical portion extending between said hemispherical portion and said press-sealed portion, and wherein said hemispherical portion, said cylindrical portion, and said press-sealed portion all integrally consist of said glass material and all uniformly have said color developed in said glass material.

12. The wedge base bulb according to claim 10, consisting of said bulb body, said at least one filament, said two respective electrical leads, and said tubular insulation collar, and excluding a colored coating on an outer surface of said bulb body.

13. The wedge base bulb according to claim 10, wherein said color-developing agent is a compound selected from a group consisting of CdS, $Cu_2O$, FeS, $SbS_2$ and $Sb_2S_3$.

14. The wedge base bulb according to claim 10, wherein said color-developing agent is a mixture of CdS and CdSe.

15. The wedge base bulb according to claim 10, wherein said color-developing agent is an element selected from a group consisting of Cu, Ag, Au, S, Se and P.

16. The wedge base bulb according to claim 10, wherein said tubular insulation collar is a molded unitary component of an insulating material with a tubular cavity therein having an open insertion end and at least one lead protrusion opening opposite said open insertion end, and said tubular insulation collar is fitted onto said press-sealed portion of said bulb body by linearly pushing said tubular insulation collar onto said press-sealed portion while slidingly inserting said press-sealed portion and said leads into said open insertion end of said tubular cavity so that said leads protrude out of said at least one lead protrusion opening.

* * * * *